US010816933B2

(12) United States Patent
Villar

(10) Patent No.: US 10,816,933 B2
(45) Date of Patent: Oct. 27, 2020

(54) MECHANICAL BRAKING DEVICE FOR TIMEPIECE WHEEL SET

(71) Applicant: ETA SA Manufacture Horlogere Suisse, Grenchen (CH)

(72) Inventor: Ivan Villar, Brugg (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 332 days.

(21) Appl. No.: 15/935,618

(22) Filed: Mar. 26, 2018

(65) Prior Publication Data

US 2018/0307183 A1 Oct. 25, 2018

(30) Foreign Application Priority Data

Apr. 24, 2017 (EP) ..... 17167802

(51) Int. Cl.
*G04B 13/02* (2006.01)

(52) U.S. Cl.
CPC ..... *G04B 13/023* (2013.01); *G04B 13/021* (2013.01); *G04B 13/022* (2013.01)

(58) Field of Classification Search
CPC ..... G04B 13/00; G04B 13/02; G04B 13/021–023
See application file for complete search history.

(56) References Cited

U.S. PATENT DOCUMENTS

2014/0056112 A1* 2/2014 Villaret ..... G04B 13/00 368/33
2016/0026154 A1 1/2016 Courvoisier
2017/0060091 A1* 3/2017 Heise ..... G04B 17/285

FOREIGN PATENT DOCUMENTS

EP 2 977 829 A1 1/2016
FR 1 124 446 10/1956
JP 50 4772 U 1/1975

OTHER PUBLICATIONS

European Search Report dated Oct. 13, 2017 in European application 17167802.2, filed on Apr. 24, 2017 (with English Translation of Categories Cited).

* cited by examiner

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A timepiece mechanism includes a structure in which at least one arbor of a wheel set is pivoted about an axis of rotation and a braking device for the mechanical braking at constant torque of this arbor. The braking device includes a braking component which is removable with respect to the structure and includes, for attachment thereof to the structure, a solid felloe, which carries a plurality of resilient elements, regularly distributed around a common axis about which these resilient elements each have a contact area. The contact areas together defining an opening, arranged to engage, in a press fit with elastic gripping, with the arbor, to make the common axis coincide with the axis of rotation of the arbor, and to apply to the arbor a substantially constant tangential braking force.

12 Claims, 4 Drawing Sheets

MECHANICAL BRAKING DEVICE FOR TIMEPIECE WHEEL SET

This application claims priority from European Patent Application No. 17167802.2 filed on Apr. 24, 2017, the entire disclosure of which is hereby incorporated herein by reference.

FIELD OF THE INVENTION

The invention concerns a timepiece mechanism comprising at least one structure in which at least one arbor of a wheel set is pivoted about an axis of rotation, said mechanism comprising at least one braking device for the mechanical braking at constant torque of a said arbor.

The invention also concerns a timepiece movement including at least one such timepiece mechanism.

The invention also concerns a watch including at least one such movement and/or at least one such timepiece mechanism.

The invention concerns the field of timepiece mechanisms, particularly display mechanisms.

BACKGROUND OF THE INVENTION

In a loose gear train, angular play between the moving display parts produces an unattractive visual effect for the user, known as fluttering, as is commonly seen in the hand of a small seconds display with a loose gear train.

Certain systems already exist, such as magnetic brakes, flexible teeth or springs acting as brakes. These are often leaf springs (metal foils) or strips rubbing on the wheel set, which have the drawback of producing a large variation in friction force and thus a variable disruption of operation.

SUMMARY OF THE INVENTION

The invention proposes to reduce backlash, simply and economically, in display wheel sets with a loose gear train.

To this end, the invention concerns a timepiece mechanism according to claim 1.

The invention also concerns a timepiece movement including at least one such timepiece mechanism.

The invention also concerns a watch including at least one such movement and/or at least one such timepiece mechanism.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
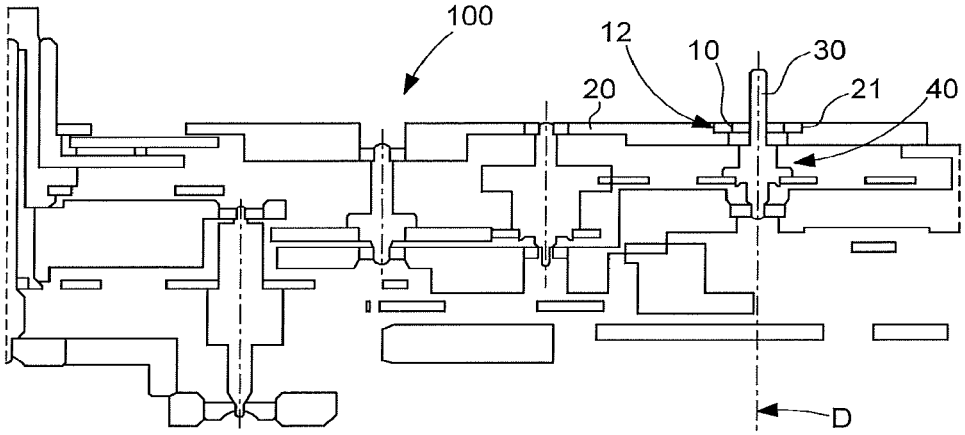
FIG. 1 represents a schematic, partial cross-sectional view of one portion of a timepiece movement comprising a mechanism according to the invention, with a wheel set whose arbor is pivoted, on a first side, in a conventional manner, with respect to the structure of the movement, and, on a second, opposite side, in a braking device arranged for the mechanical braking of the wheel set at constant torque, in a first variant.

The invention concerns a timepiece mechanism 100 comprising at least one structure 20 in which is pivoted at least one arbor 30 of a wheel set 40 about an axis of rotation D.

This mechanism 100 comprises at least one braking device 10 for the mechanical braking at constant torque of an arbor 30.

According to the invention, this braking device 10 comprises a braking component 1, which is removable with respect to structure 20, and which comprises, for attachment thereof to the structure, a solid felloe 2, which carries a plurality of resilient elements 3.

These resilient elements 3 are preferably identical and regularly distributed around a common axis AC about which resilient elements 3 each have a contact area 4. Contact areas 4 together define an opening 5, which is arranged to engage, in a press fit with elastic gripping, with an arbor 30, to make common axis AC coincide with axis of rotation D of arbor 30, and to apply to arbor 30 a substantially constant tangential braking force.

The value of the gripping force on the arbor depends, of course, on the application. For ordinary horological applications the gripping may vary between a low value, on the order of 5 micrometres on the radius, and a high value, on the order of 10 micrometres on the radius.

It is understood that these resilient elements 3 may also each be a combination of resilient elements, not necessarily identical, nor necessarily regularly distributed around common axis AC, but the resultant of the bearing forces that they exert on an arbor 30 must be zero, and distribution of the torque that they exert on this arbor 30 must be regular.

Figure 2:
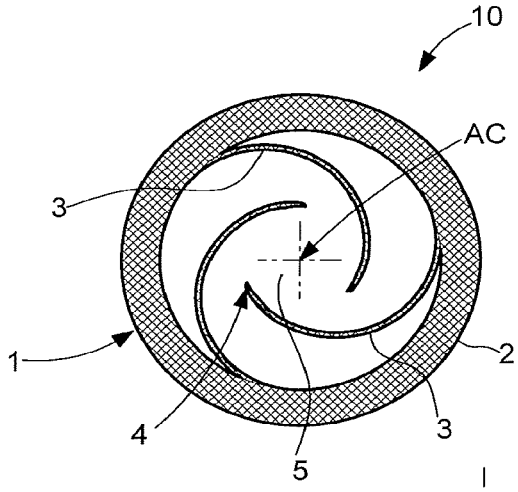
FIG. 2 represents a schematic, plan view of this braking device according to the first variant, comprising a solid, substantially circular felloe, carrying resilient elements arranged to support and brake the arbor of the wheel set.
Figure 3:
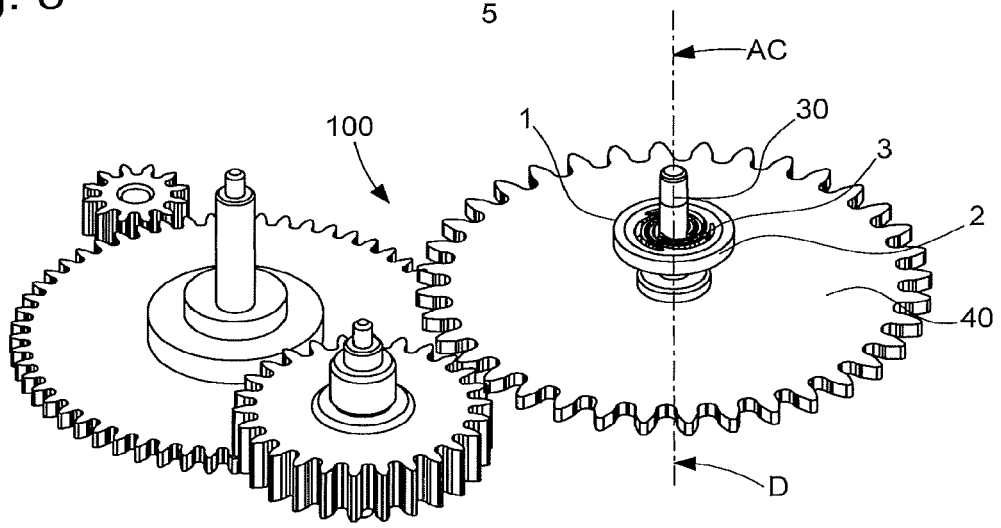
FIG. 3 shows a schematic, partial, perspective view of such a mechanism with a braking device according to the first variant.
Figure 4:
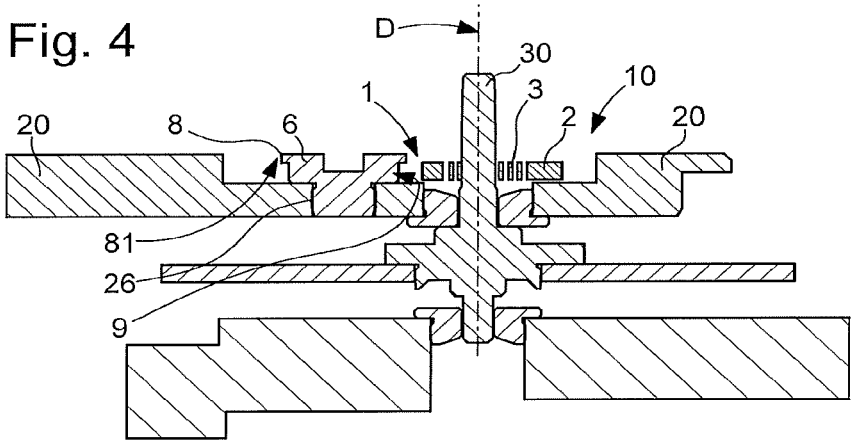
FIG. 4 represents, in a similar manner to FIG. 1, another mechanism according to the invention, in a second variant of the braking device which includes a fork on one side of its felloe, and wherein the fork cooperates with clearance with a limiting bolt, which is fixed to the movement structure.
Figure 5:
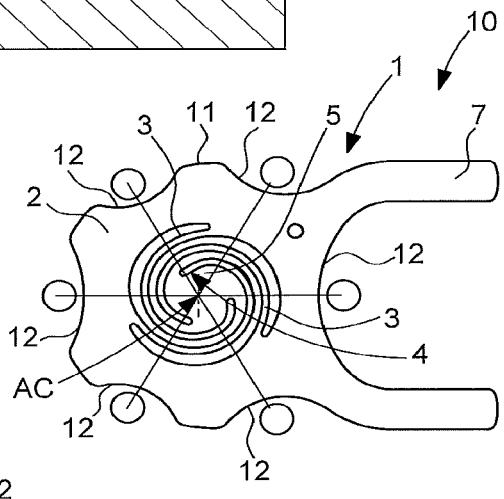
FIG. 5 shows, in a similar manner to FIG. 2, the braking device according to the first variant.
Figure 6:
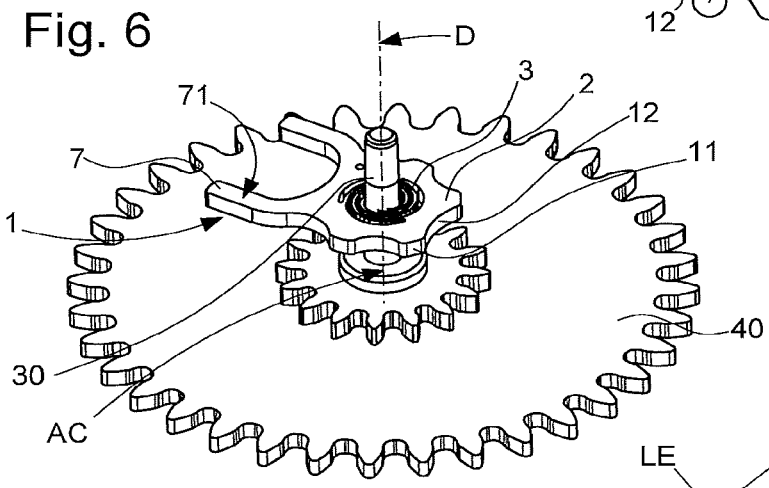
FIG. 6 represents, in a similar manner to FIG. 3, the mechanism according to the second variant.
Figure 7:
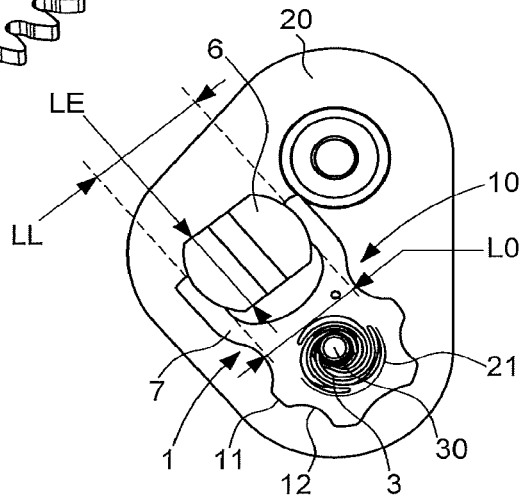
FIG. 7 represents a schematic, top view of the mechanism according to the second variant.
Figure 8:
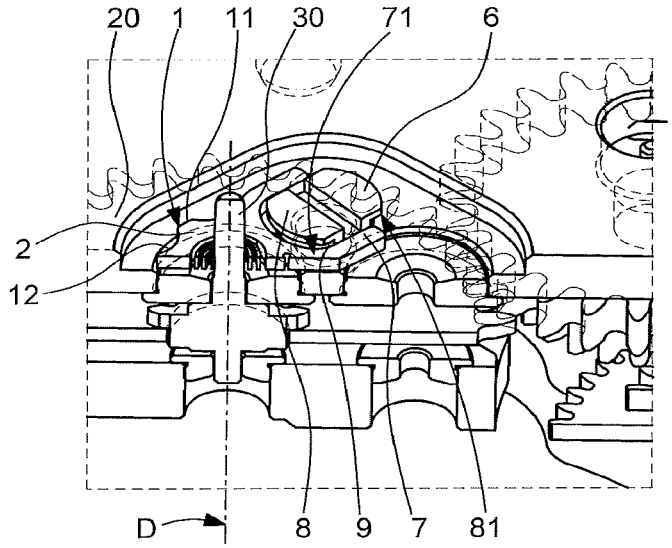
FIG. 8 shows a schematic, partial, exploded perspective view of the mechanism according to the second variant.
Figure 9:
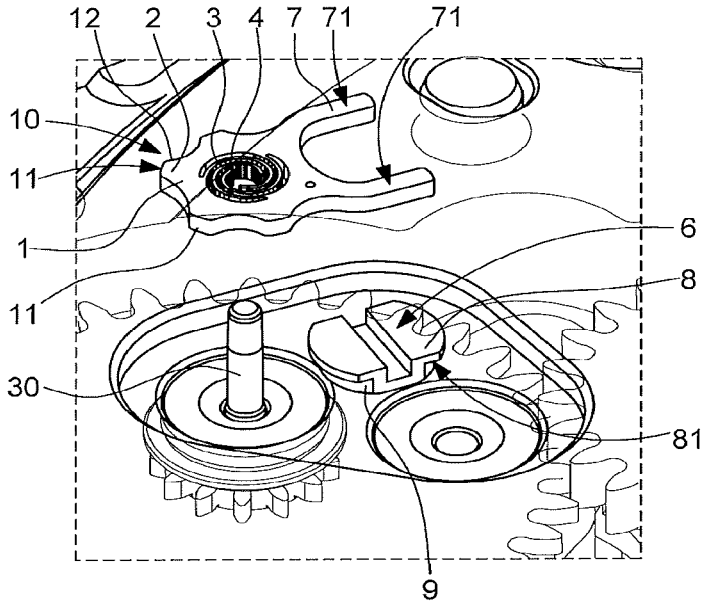
FIG. 9 represents a schematic, perspective view of the same mechanism when a narrow portion of the limiting bolt is made to engage through the opening in the fork.
Figure 10:
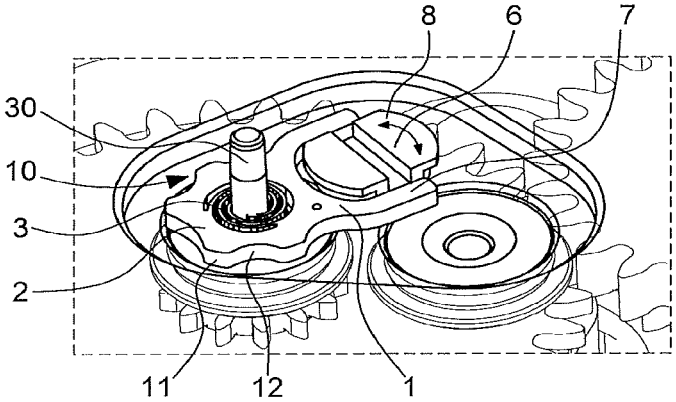
FIG. 10 represents, in the same manner, the same mechanism when a wide portion of the limiting bolt is made to engage in axially limiting the fork.
Figure 11:
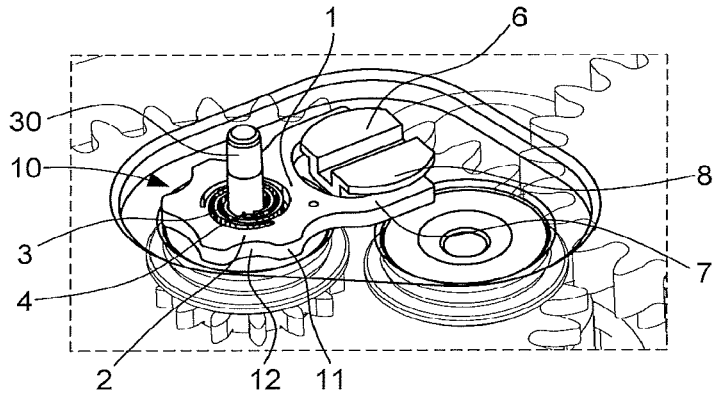
FIG. 11 represents, in the same manner, the same mechanism in its service position after a wide portion of the limiting bolt has been engaged in axially limiting the fork.
Figure 12:
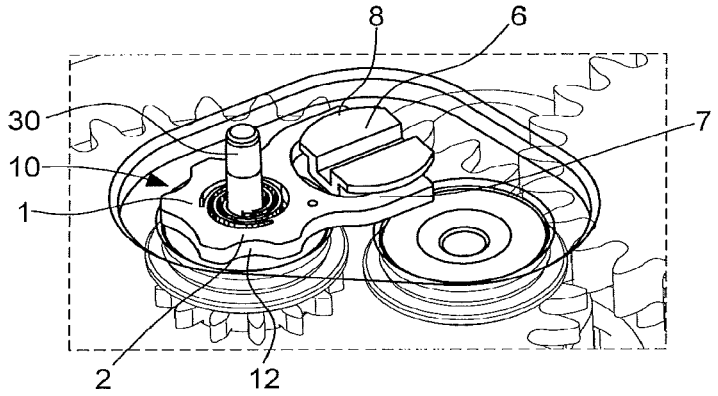
FIG. 12 represents, in the same manner, the same mechanism in another position, with respect to the movement structure, of the same bolt, with respect to the same braking device.
Figure 13:
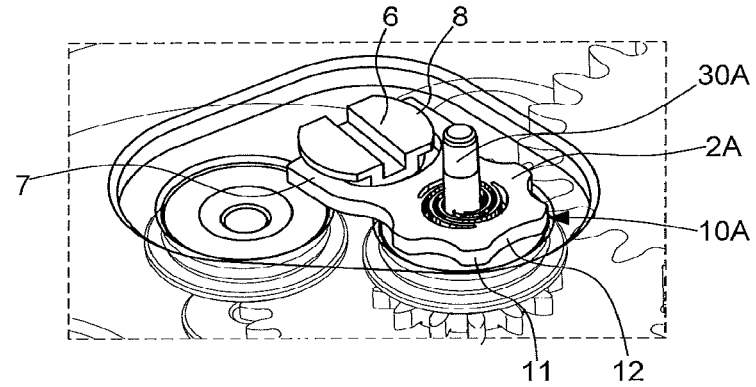
FIG. 13 represents, in the same manner, the same mechanism in another opening, with respect to the movement structure, of the same bolt, with respect to the same braking device.
Figure 14:
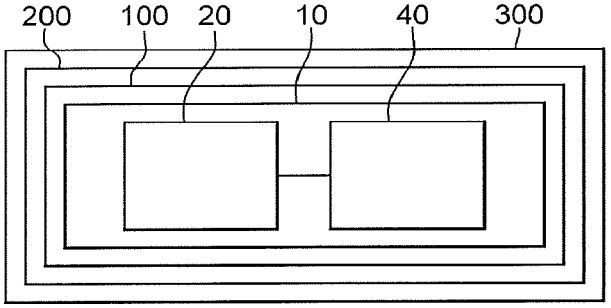
FIG. 14 is a block diagram representing a watch including a movement with such a mechanism.

It is, of course, possible to envisage press fitting a braking structure 1, such as that illustrated in FIG. 2, into structure 20. However, this configuration requires total absence of burrs, and high machining precision, which results in manufacturing costs.

Thus, it is advantageous, in a particular implementation, to produce a self-centering braking component 1, having two degrees of freedom in a plane, but held in the third dimension, height, by a bolt.

Thus, more particularly, braking device 10 also comprises a positioning bolt 6. This bolt 6 is arranged to be fixed to a recess 26 comprised in structure 20, confining braking component 1 so as to allow it axial play limited to a restricted axial value, in the direction of common axis AC, and/or to allow it backlash limited to a restricted angular value, in a plane perpendicular to common axis AC. Thus, in this advantageous variant, braking component 1 is no longer fitted inside structure 20, but positioned by bolt 6, which does not block braking component 1. Bolt 6 allows a radial and axial degree of freedom to braking component 1, so that the latter self-centres and thus offsets geometric variations.

In a particular variant illustrated by the Figures, braking component 1 comprises, in a plane perpendicular to common axis AC, a fork 7. This fork 7 is arranged to surround a shoulder 9 of bolt 6 with a clearance corresponding to the restricted angular value. An upper face 71 of fork 7 is arranged to cooperate in abutment with at least one lower face 81, comprised in a collar 8 of bolt 6, to limit the axial travel of braking component 1.

More particularly, this collar 8 comprises, in a first direction, a narrow portion of smaller width LE than the opening in fork 7, to allow for insertion of braking component 1 on arbor 30 in proximity to bolt 7 fixed in a first angular position of insertion, on structure 20. Collar 8 comprises, in a second direction, preferably but not restricted to a direction orthogonal to the first direction, a wide portion, which is of greater width LL than opening LO in fork 7. This wide portion carries the at least one lower face 81 which axially immobilises fork 7 in a second angular locking position of bolt 6.

Bolt 6 can simply be pressed into recess 26 of structure 20, in other variants it can be assembled by screws, or with a bayonet connection, or other. The axial play, like the radial play, is preferably but not limited to between 10 and 30 micrometres, more particularly between 15 and 25 micrometres.

In a particular variant, felloe 2 of braking component 1 comprises, in a plane perpendicular to common axis AC, hollowed portions 12, in diametrically opposite pairs with respect to common axis AC, and which are arranged to allow braking component 1 to be manipulated by a robot manipulator grip or gripped easily with tweezers by an operator.

Braking component 1 can simply be placed on a bearing surface of structure 20, on which it is preferably held by bolt 6. In a particular variant, felloe 2 of braking component 1 comprises, in a perpendicular plane to common axis AC, radial stops 11 which are arranged to cooperate in radial abutment with a recessed portion 21 comprised in structure 20, to limit the radial travel of common axis AC with respect to axis of rotation D of arbor 30. More particularly, these radial stops 11 are alternated with all or part of hollowed portions 12, when braking component 1 comprises the same.

In a particular application of this timepiece mechanism 100, a wheel set 40 is a small seconds display wheel set, whose arbor is generally rolled and slightly conical. The solution offered by the invention is well suited to this case, due to the moderate cost, compactness, precision and surface state of the components involved, and easy to assemble due to the cone of the wheel set arbor.

In another variant, structure 20 comprises a plurality of recesses, which are arranged for pivoting different arbors 30 of different wheel sets 40, about the same recess 26, which is arranged to receive a bolt 6 able to engage with a braking component 1 arranged on any one of arbors 30. Thus, for example, the system can cope with different distances between centres of the small seconds hand, using the same components.

In yet another variant, felloe 2A of braking component 1 is placed in another recess of structure 20 with a different wheel set. Felloe 2A is held in place by bolt 6 with collar 8 and fork 7 of the braking device 10A. Braking component 1 rotates around an axis of rotation of different arbor 30A.

In yet another variant, felloe 2 of braking component 1 comprises a peripheral shoulder which is arranged, in a plane perpendicular to common axis AC, to engage in a press fit with a recess 21 comprised in structure 20.

In a particular embodiment, braking component 1 is in one piece and made of micromachinable material, such as silicon, DLC, or other. Manufacture by a lithographic or similar method guarantees high geometric precision, and a good and especially reproducible surface state.

The invention also concerns a timepiece movement 200 including at least one such timepiece mechanism 100.

A particular application of the invention concerns application to a chronograph mechanism.

The invention also concerns a watch 300 including at least one such movement 200, and/or at least one such timepiece mechanism 100.

In short, the use of a braking component, as described above, similar to a washer with flexible arms rubbing on the pivot of a wheel set, particularly of a small seconds wheel, is particularly advantageous, owing to the reproducibility of the behaviour of the wheel set, resulting from the method for manufacturing the braking component. In the example of the small seconds wheel pivot, the invention also takes advantage of the high geometric precision and good surface condition produced by rolling. The variation in friction force, which was unacceptable in the prior art, is reduced, or eliminated, which results in less variation in operation.

What is claimed is:

1. A timepiece mechanism comprising:

at least one structure in which at least one arbor of a wheel set is pivoted about an axis of rotation; and at least one braking device for the mechanical braking at constant torque of said arbor, wherein said braking device comprises a braking component that is removable with respect to said structure and which comprises, for attachment thereof to said structure, a solid felloe, which carries a plurality of identical resilient elements, regularly distributed around a common axis about which said resilient elements each have a contact area, said contact areas defining together an opening arranged to engage, in a press fit with elastic gripping, with said arbor, to make said common axis coincide with said axis of rotation of said arbor, and to apply to said arbor a substantially constant tangential braking force, wherein said braking device further comprises a positioning bolt, arranged to be fixed in an recess comprised in said structure, confining said braking component so as to allow said braking component axial play limited to a restricted axial value, in the direction of said common axis, and/or to allow said braking component backlash limited to a restricted angular value, in a plane perpendicular to said common axis, and wherein said braking component comprises, in a plane perpendicular to said common axis, a fork arranged to surround a shoulder of said bolt with a clearance corresponding to said restricted angular value, and wherein an upper face of said fork is arranged to cooperate in abutment with at least one lower face comprised in a collar of said bolt to limit the axial travel of said braking component.

2. The timepiece mechanism according to claim 1, wherein said collar comprises, in a first direction, a narrow portion of smaller width than the opening in said fork, to allow for insertion of said braking component on said arbor in proximity to said bolt fixed in a first angular position of insertion, on said structure, and comprises, in a second direction orthogonal to said first direction, a wide portion of greater width than the opening in said fork, and bearing said at least one lower face which axially immobilises said fork in a second angular locking position of said bolt.

3. The timepiece mechanism according to claim 1, wherein said felloe of said braking component comprises, in a plane perpendicular to said common axis, radial stops arranged to cooperate in radial abutment with a recessed portion comprised in said structure, to limit the radial travel of said common axis with respect to said axis of rotation of said arbor.

4. The timepiece mechanism according to claim 1, wherein said structure comprises a plurality of recesses arranged for pivoting different said arbors of different said wheel sets, about the same said recess arranged to receive said bolt capable of cooperating with said braking component arranged on any one of said arbors.

5. The timepiece mechanism according to claim 1, wherein said felloe of said braking component comprises a peripheral shoulder arranged, in a plane perpendicular to said common axis, to engage in a press fit with a recessed portion comprised in said structure.

6. The timepiece mechanism according to claim 1, wherein said braking component is made in one piece and of micromachinable material.

7. The timepiece mechanism according to claim 1, wherein one said wheel set is a seconds display wheel set.

8. A timepiece movement comprising:

at least one timepiece mechanism according to claim 1.

9. A watch comprising:

at least one timepiece mechanism according to claim 1.

10. The timepiece mechanism according to claim 1, wherein the arbor is conical.

11. The timepiece mechanism according to claim 1, wherein the braking device is made of silicon.

12. A timepiece mechanism comprising:

at least one structure in which at least one arbor of a wheel set is pivoted about an axis of rotation; and at least one braking device for the mechanical braking at constant torque of said arbor, wherein said braking device comprises a braking component that is removable with respect to said structure and which comprises, for attachment thereof to said structure, a solid felloe, which carries a plurality of identical resilient elements, regularly distributed around a common axis about which said resilient elements each have a contact area, said contact areas defining together an opening arranged to engage, in a press fit with elastic gripping, with said arbor, to make said common axis coincide with said axis of rotation of said arbor, and to apply to said arbor a substantially constant tangential braking force, wherein said braking device further comprises a positioning bolt, arranged to be fixed in an recess comprised in said structure, confining said braking component so as to allow braking component axial play limited to a restricted axial value, in the direction of said common axis, and/or to allow braking component backlash limited to a restricted angular value, in a plane perpendicular to said common axis, and wherein said structure comprises a plurality of recesses arranged for pivoting different said arbors of different said wheel sets, about the same said recess arranged to receive said bolt capable of cooperating with said braking component arranged on any one of said arbors.

* * * * *